US007419586B2

(12) United States Patent
Ellis et al.

(10) Patent No.: US 7,419,586 B2
(45) Date of Patent: Sep. 2, 2008

(54) TWO-STAGE HYDRODESULFURIZATION OF CRACKED NAPHTHA STREAMS WITH LIGHT NAPHTHA BYPASS OR REMOVAL

(75) Inventors: Edward S. Ellis, Basking Ridge, NJ (US); John P. Greeley, Annandale, NJ (US); Vasant Patel, Sugar Land, TX (US); Murali V. Ariyapadi, Sugar Land, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 357 days.

(21) Appl. No.: 11/286,578

(22) Filed: Nov. 23, 2005

(65) Prior Publication Data

US 2006/0278567 A1 Dec. 14, 2006

Related U.S. Application Data

(60) Provisional application No. 60/639,253, filed on Dec. 27, 2004.

(51) Int. Cl.
*C10G 45/04* (2006.01)

(52) U.S. Cl. ..... 208/213; 208/210; 208/211; 208/212; 208/216 R; 208/217; 208/218

(58) Field of Classification Search ..... 208/213, 208/211, 212, 210, 216 R, 217, 228
See application file for complete search history.

(56) References Cited

U.S. PATENT DOCUMENTS 5,114,562 A 5/1992 Haun et al. ..... 208/89
5,968,347 A * 10/1999 Kolodziej et al. ..... 208/213
5,985,136 A 11/1999 Brignac et al. ..... 208/216 R
6,013,598 A 1/2000 Lapinski et al. ..... 502/305
6,126,814 A 10/2000 Lapinski et al. ..... 208/217
6,231,753 B1 5/2001 McKnight et al. ..... 208/217
6,592,750 B2 7/2003 Podrebarac et al. ..... 208/210
6,676,829 B1 * 1/2004 Angevine et al. ..... 208/210
6,855,246 B2 2/2005 Chapus et al. ..... 208/210
6,913,688 B2 7/2005 Coker et al. ..... 208/210
6,972,086 B2 12/2005 Didillon et al. ..... 208/210

FOREIGN PATENT DOCUMENTS

WO 03/044131 5/2003

* cited by examiner

*Primary Examiner*—Tam M. Nguyen
(74) *Attorney, Agent, or Firm*—Lawrence E. Carter

(57) ABSTRACT

A process for the selective hydrodesulfurization of olefinic naphtha streams containing a substantial amount of organically-bound sulfur and olefins. The olefinic naphtha stream is selectively desulfurized in a first hydrodesulfurization stage. The effluent stream from this first stage is sent to a separation zone wherein a lower boiling naphtha stream and a higher boiling naphtha stream are produced. The lower boiling naphtha stream is sent through at least two more separation zones, each at a lower temperature than the preceding separation stage. The higher boiling naphtha stream, which contains most of the sulfur moieties, is passed to a second hydrodesulfurization stage wherein at least a fraction of the sulfur moieties are removed.

9 Claims, 1 Drawing Sheet

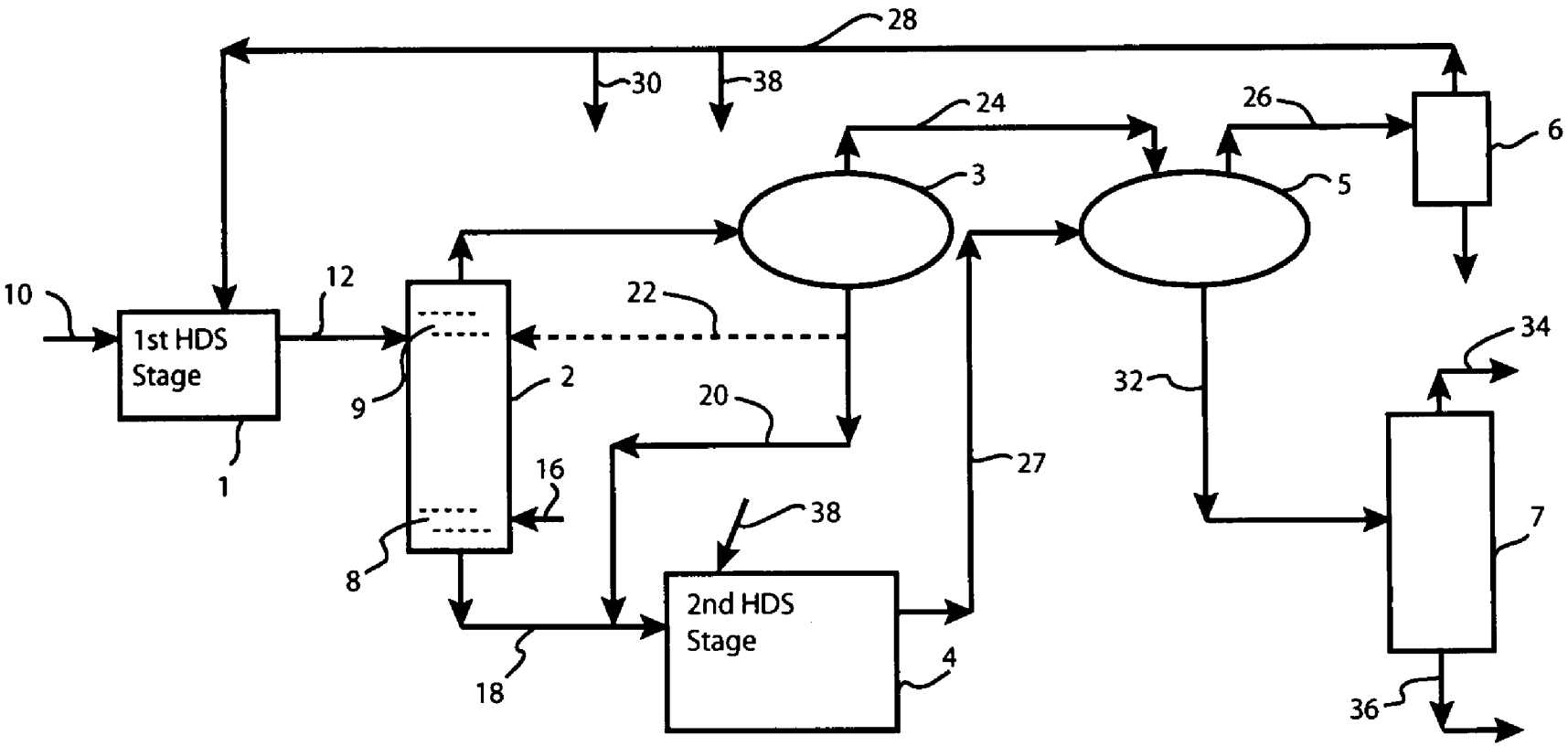
1st HDS Stage
2nd HDS Stage
1
2
3
4
5
6
7
8
9
10
12
16
18
20
22
24
26
27
28
30
32
34
36
38
38

TWO-STAGE HYDRODESULFURIZATION OF CRACKED NAPHTHA STREAMS WITH LIGHT NAPHTHA BYPASS OR REMOVAL

CROSS-REFERENCE TO RELATED APPLICATION

This application claims benefit of U.S. Provisional Patent Application Ser. No. 60/639,253 filed Dec. 27, 2004.

FIELD OF THE INVENTION

The present invention relates to a multi-stage process for the selective hydrodesulfurization of an olefinic naphtha stream containing a substantial amount of organically-bound sulfur and olefins.

BACKGROUND OF THE INVENTION

Environmentally-driven, regulatory pressure concerning motor gasoline sulfur levels will result in the widespread production of less than 50 wppm sulfur mogas by the year 2004, and levels below 10 wppm are being considered for later years. In general, this will require deep desulfurization of cat naphthas. That is, naphthas resulting from cracking operations, particularly those from a fluid catalytic cracking unit. Cat naphthas typically contain substantial amounts of both sulfur and olefins. Deep desulfurization of cat naphtha requires improved technology to reduce sulfur levels without the severe loss of octane that accompanies the undesirable hydrogenation of olefins.

Hydrodesulfurization is one of the fundamental hydrotreating processes of refining and petrochemical industries. The removal of organically-bound sulfur in the feed by conversion to hydrogen sulfide is typically achieved by reaction with hydrogen over non-noble metal sulfided supported and unsupported catalysts, especially those containing Co/Mo or Ni/Mo. This is usually achieved at fairly severe temperatures and pressures in order to meet product quality specifications, or to supply a desulfurized stream to a subsequent sulfur-sensitive process.

Olefinic naphthas, such as cracked naphthas and coker naphthas, typically contain more than about 20 wt. % olefins. Conventional fresh hydrodesulfurization catalysts have both hydrogenation and desulfurization activity. Hydrodesulfurization of cracked naphthas using conventional naphtha desulfurization catalysts under conventional startup procedures and under conventional conditions required for sulfur removal, typically leads to an undesirable loss of olefins through hydrogenation. Since olefins are high octane components, for some motor fuel use, it is desirable to retain the olefins rather than to hydrogenate them to saturated compounds that are typically lower in octane. This results in a lower grade fuel product that needs additional refining, such as isomerization, blending, etc., to produce higher octane fuels. Such additional refining, or course, adds significantly to production costs.

Selective hydrodesulfurization to remove organically-bound sulfur, while minimizing hydrogenation of olefins and octane reduction by various techniques, such as selective catalysts and/or process conditions, has been described in the art. For example, a process referred to as SCANfining has been developed by Exxon Mobil Corporation in which olefinic naphthas are selectively desulfurized with little loss in octane. U.S. Pat. Nos. 5,985,136; 6,013,598; and 6,126,814; all of which are incorporated herein by reference, disclose various aspects of SCANfining. Although selective hydrodesulfurization processes have been developed to avoid significant olefin saturation and loss of octane, such processes have a tendency to liberate $H_2S$ that reacts with retained olefins to form mercaptan sulfur by reversion.

Many refiners are considering combinations of available sulfur removal technologies in order to optimize economic objectives. As refiners have sought to minimize capital investment to meet low sulfur mogas objectives, technology providers have devised various strategies that include distillation of the cracked naphtha into various fractions that are best suited to individual sulfur removal technologies. While economics of such strategies may appear favorable compared to a single processing technology, the complexity of overall refinery operations is increased and successful mogas production is dependent upon numerous critical sulfur removal operations. Economically competitive sulfur removal strategies that minimize olefin saturation and capital investment and operational complexity will be favored by refiners.

Consequently, there is a need in the art for technology that will reduce the cost of hydrotreating both cracked naphthas, such as cat cracked naphthas and coker naphthas. There is also a need for more economical hydrotreating processes that minimize both olefin saturation and mercaptan reversion.

SUMMARY OF THE INVENTION

In accordance with the present invention, there is provided a process for hydrodesulfurizing olefinic naphtha feedstreams and retaining a substantial amount of the olefins, which feedstream boils in the range of about 50° F. (10° C.) to about 450° F. (232° C.) and contains organically-bound sulfur and an olefin content of at least about 5 wt. %, which process comprises:

a) hydrodesulfurizing the olefinic naphtha feedstream in a first hydrodesulfurization stage in the presence of hydrogen and a hydrodesulfurization catalyst, at hydrodesulfurization reaction conditions including temperatures from about 232° C. (450° F.) to about 427° C. (800° F.), pressures of about 60 to 800 psig (about 515 to 5,617 kPa), and hydrogen treat gas rates of about 1000 to about 6000 standard cubic feet per barrel (about 178 to about 1,068 $m^3/m^3$), to convert at least about 50 wt. %, but not all, of the organically-bound sulfur to hydrogen sulfide and to produce a sulfur-containing first product stream;

b) conducting said sulfur-containing first product stream to a first separation zone operated at a temperature from about 200° F (93° C.) to about 350° F. (177° C.) where it is contacted with a countercurrent flow of hydrogen treat gas to produce a first lower boiling naphtha product stream and a first higher boiling naphtha product stream, wherein the higher boiling product stream contains greater than about 50 wt. % of the sulfur from the first product stream;

c) conducting said first lower boiling naphtha product stream to a second separation zone operated at a temperature at least about 10° C. (50° F.) lower than that of said first separation stage wherein a second lower boiling naphtha product stream and a second higher boiling product stream are produced, which second higher boiling product stream contains substantially all of the sulfur from said first lower boiling naphtha product stream;

d) conducting said second lower boiling product stream from said second separation stage to a third separation stage which is maintained at a temperature at least about 30° F. (−1° C.) lower than that of said second separation stage thereby resulting in a hydrogen containing vapor recycle stream and a desulfurized naphtha product stream;

e) conducting said first higher boiling naphtha product stream from said first separation zone and at least a portion of said second higher boiling naphtha stream from said second separation zone to a second hydrodesulfurization stage in the presence of hydrogen treat gas and a hydrodesulfurization catalyst, at hydrodesulfurization reaction conditions including temperatures from about 232° C. (450° F.) to about 427° C. (800° F.), pressures of about 60 to about 800 psig (about 515 to about 5,617 kPa), and hydrogen treat gas rates of about 1000 to about 6000 standard cubic feet per barrel (about 178 to about 1,068 $m^3/m^3$), to convert at least a portion of any remaining organically-bound sulfur to hydrogen sulfide;

f) recycling at least a portion of the hydrogen-containing vapor recycle stream from said third separation zone to said first hydrogenation stage;

g) stripping substantially all remaining hydrogen from said desulfurized naphtha product stream from said third separation zone; and h) collecting said stripped higher boiling naphtha product stream.

In a preferred embodiment, at least a portion of said higher boiling naphtha product stream from said second separation zone is conducted to said first separation zone and flows downward countercurrent to an upflowing hydrogen stream.

In another preferred embodiment, at least a portion of said hydrogen-containing vapor from said third separation zone is conducted to said first separation zone where it flows countercurrent to downflowing naphtha.

In still another preferred embodiment of the present invention, the hydrodesulfurization catalyst for either the first, second, or both hydrodesulfurization zones is comprised of a Mo catalytic component, a Co catalytic component and a support component, with the Mo component being present in an amount of from about 1 to about 25 wt. % calculated as $MoO_3$ and the Co component being present in an amount of from about 0.1 to about 5 wt. % calculated as CoO, with a Co/Mo atomic ratio of 0.1 to 1.

BRIEF DESCRIPTION OF THE DRAWING

The FIGURE hereof is a representation of one preferred process scheme for practicing the present invention.

DETAILED DESCRIPTION OF THE INVENTION

Feedstocks suitable for use in the present invention are olefinic naphtha boiling range refinery streams that typically boil in the range of about 10° C. (50° F.) to about 232° C. (450° F.). The term "olefinic naphtha stream" as used herein are those naphtha streams having an olefin content of at least about 5 wt. %. Non-limiting examples of olefinic naphtha streams include fluid catalytic cracking unit naphtha (FCC catalytic naphtha or cat naphtha), steam cracked naphtha, and coker naphtha. Also included are blends of olefinic naphthas with non-olefinic naphthas as long as the blend has an olefin content of at least about 5 wt. %.

Olefinic naphtha refinery streams generally contain not only paraffins, naphthenes, and aromatics, but also unsaturates, such as open-chain and cyclic olefins, dienes, and cyclic hydrocarbons with olefinic side chains. The olefinic naphtha feedstock can contain an overall olefins concentration ranging as high as about 60 wt. %, more typically as high as about 50 wt. %, and most typically from about 5 wt. % to about 40 wt. %. The olefmic naphtha feedstock can also have a diene concentration up to about 15 wt. %, but more typically less than about 5 wt. % based on the total weight of the feedstock. High diene concentrations are undesirable since they can result in a gasoline product having poor stability and color. The sulfur content of the olefinic naphtha will generally range from about 300 wppm to about 7000 wppm, more typically from about 1000 wppm to about 6000 wppm, and most typically from about 1500 to about 5000 wppm. The sulfur will typically be present as organically-bound sulfur. That is, as sulfur compounds such as simple aliphatic, naphthenic, and aromatic mercaptans, sulfides, di- and polysulfides and the like. Other organically-bound sulfur compounds include the class of heterocyclic sulfur compounds such as thiophene and its higher homologs and analogs. Nitrogen will also be present and will usually range from about 5 wppm to about 500 wppm.

As previously mentioned, it is highly desirable to remove sulfur from olefinic naphthas with as little olefin saturation as possible. It is also highly desirable to convert as much as the organic sulfur species of the naphtha to hydrogen sulfide with as little mercaptan reversion as possible. The level of mercaptans in the product stream has been found to be directly proportional to the concentration of both hydrogen sulfide and olefinic species at the reactor outlet, and inversely related to the temperature at the reactor outlet.

The sole FIGURE hereof is a simple flow scheme of a best mode for practicing the present invention. Various ancillary equipment, such as compressors, pumps, and valves are not shown for simplicity reasons. An olefinic naphtha feed is conducted via line 10 to first hydrodesulfurization zone 1 that is preferably operated in selective hydrodesulfurization conditions that will vary as a function of the concentration and types of organically-bound sulfur species of the feedstream. By "selective hydrodesulfurization" we mean that the hydrodesulfurization zone is operated in a manner to achieve as high a level of sulfur removal as possible with as low a level of olefin saturation as possible. It is also operated to avoid as much mercaptan reversion as possible. Generally, hydrodesulfurization conditions, for both the first and second hydrodesulfurization zones, as well as any subsequent hydrodesulfurization zone include: temperatures from about 232° C. (450° F.) to about 427° C. (800° F.), preferably from about 260° C. (500° F.) to about 355° C. (671° F.); pressures from about 60 to about 800 psig (about 515 to about 5,617 kPa), preferably from about 200 to about 500 psig (about 1,480 kPa to about 3,549 kPa); hydrogen feed rates of about 1000 to about 6000 standard cubic feet per barrel (scf/b) (about 178 to about 1,068 $m^3/m^3$), preferably from about 1000 to about 3000 scf/b (about 178 to about 534 $m^3/m^3$); and liquid hourly space velocities of about 0.5 $hr^{-1}$ to about 15 $hr^{-1}$, preferably from about 0.5 $hr^{-1}$ to about 10 $hr^{-1}$, more preferably from about 1 $hr^{-1}$ to about 5 $hr^{-1}$. The terms "hydrotreating" and "hydrodesulfurization" are sometimes used interchangeably herein.

This first hydrodesulfurization reaction zone can be comprised of one or more fixed bed reactors each of which can comprise one or more catalyst beds of the same, or different, hydrodesulfurization catalyst. Although other types of catalyst beds can be used, fixed beds are preferred. Non-limiting examples of such other types of catalyst beds that may be used in the practice of the present invention include fluidized beds, ebullating beds, slurry beds, and moving beds. Interstage cooling between reactors, or between catalyst beds in the same reactor, can be employed since some olefin saturation can take place, and olefin saturation as well as the desulfurization reaction are generally exothermic. A portion of the heat generated during hydrodesulfarization can be recovered by conventional techniques. Where this heat recovery option is not available, conventional cooling may be performed through cooling utilities such as cooling water or air, or by use of a hydrogen quench stream. In this manner, optimum reaction temperatures can be more easily maintained. It is preferred that the first hydrodesulfurization stage be configured in a manner and operated under hydrodesulfurization conditions such that from about 20% to about 75%, more preferably from about 20% to about 60% of the total targeted sulfur removal is reached in the first hydrodesulfurization stage.

Hydrotreating catalysts suitable for use in both the first and second hydrodesulfurization zones are those that are comprised of at least one Group VIII metal oxide, preferably an oxide of a metal selected from Fe, Co and Ni, more preferably selected from Co and/or Ni, and most preferably Co, and at least one Group VI metal oxide, preferably an oxide of a metal selected from Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same reaction vessel. The Group VIII metal oxide of the first hydrodesulfurization catalyst is typically present in an amount ranging from about 2 to about 20 wt. %, preferably from about 4 to about 12 wt. %. The Group VI metal oxide will typically be present in an amount ranging from about 5 to about 50 wt. %, preferably from about 10 to about 40 wt. %, and more preferably from about 20 to about 30 wt. %. All metal oxide weight percents are on support. By "on support" we mean that the percents are based on the weight of the support. For example, if the support were to weigh 100 grams, then 20 wt. % Group VIII metal oxide would mean that 20 grams of Group VIII metal oxide is on the support.

Preferred catalysts for both the first and second hydrodesulfurization stage will also have a high degree of metal sulfide edge plane area as measured by the Oxygen Chemisorption Test as described in "Structure and Properties of Molybdenum Sulfide: Correlation of $O_2$ Chemisorption with Hydrodesulfurization Activity," S. J. Tauster et al., *Journal of Catalysis* 63, pp. 515-519 (1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to about 2,800, preferably from about 1,000 to about 2,200, and more preferably from about 1,200 to about 2,000 μmol oxygen/gram $MoO_3$.

The most preferred catalysts for the second hydrodesulfurization zone can be characterized by the properties: (a) a $MoO_3$ concentration of about 1 to about 25 wt. %, preferably about 2 to about 18 wt. %, and more preferably about 4 to about 10 wt. %, and most preferably about 4 to about 8 wt. %, based on the total weight of the catalyst; (b) a CoO concentration of about 0.1 to about 6 wt. %, preferably about 0.5 to about 5.5 wt. %, and more preferably about 1 to about 5 wt. %, also based on the total weight of the catalyst; (c) a Co/Mo atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a $MoO_3$ surface concentration of about $0.5\times10^{-4}$ to about $3\times10^{-4}$ grams $MoO_3/m^2$, preferably about $0.75\times10^{-4}$ to about $2.5\times10^{-4}$ grams $MoO_3/m^2$, more preferably from about $1\times10^{-4}$ to $2\times10^{-4}$ grams $MoO_3/m^2$; and (f) an average particle size diameter of less than 2.0 mm, preferably less than about 1.6 mm, more preferably less than about 1.4 mm, and most preferably as small as practical for a commercial hydrodesulfurization process unit.

The catalysts used in the practice of the present invention are preferably supported catalysts. Any suitable refractory catalyst support material, preferably inorganic oxide support materials, can be used as supports for the catalyst of the present invention. Non-limiting examples of suitable support materials include: zeolites, alumina, silica, titania, calcium oxide, strontium oxide, barium oxide, carbons, zirconia, diatomaceous earth, lanthanide oxides including cerium oxide, lanthanum oxide, neodynium oxide, yttrium oxide, and praesodymium oxide; chromia, thorium oxide, urania, niobia, tantala, tin oxide, zinc oxide, and aluminum phosphate. Preferred are alumina, silica, and silica-alumina. More preferred is alumina. Magnesia can also be used for the catalysts with a high degree of metal sulfide edge plane area of the present invention. It is to be understood that the support material can also contain small amounts of contaminants, such as Fe, sulfates, silica, and various metal oxides that can be introduced during the preparation of the support material. These contaminants are present in the raw materials used to prepare the support and will preferably be present in amounts less than about 1 wt. %, based on the total weight of the support. It is more preferred that the support material be substantially free of such contaminants. It is an embodiment of the present invention that about 0 to about 5 wt. %, preferably from about 0.5 to about 4 wt. %, and more preferably from about 1 to about 3 wt. %, of an additive be present in the support, which additive is selected from the group consisting of phosphorus and metals or metal oxides from Group IA (alkali metals) of the Periodic Table of the Elements.

Returning now to the FIGURE hereof, the total effluent product from first hydrodesulfurization stage 1 is passed via line 12 to first separation zone 2, which is maintained at a temperature from about 93° C. (200° F.) to about 177° C. (350° F.), to produce a first lower boiling naphtha product stream and a first higher boiling naphtha product stream. The first lower boiling naphtha product stream exits first separation zone 2 via line 14 and is conducted to second separation zone 3, which is maintained at a temperature at least about 15° C. (59° F.), preferably at least about 20° C. (68° F.), and more preferably at least about 25° C. (77° F.) cooler than first separation zone 2.

Hydrogen treat gas enters first separation zone 2 via line 16 and flows upward and countercurrent to downflowing higher boiling naphtha product stream that exits first separation zone 2 via line 18 and is passed to second hydrodesulfurization zone 4. The upflowing hydrogen treat gas stream strips out dissolved $H_2S$ from the hot liquid higher boiling naphtha product stream that is passed to second hydrodesulfurization stage 4. It is preferred that the bottom section of the first separation zone 2 contain a first gas-liquid contacting zone 8 comprised of suitable trays or other conventional gas-liquid contacting media to aid in the stripping of dissolved $H_2S$ from the exiting naphtha.

A higher boiling naphtha product stream exits second separation zone 3 via line 20 wherein at least of portion thereof is passed to second hydrodesulfurization zone 4. A portion of the higher boiling naphtha product stream from second separation zone 3 can optionally also be passed to first separation zone 2 via line 22 to flow countercurrent to up-flowing hydrogen-containing vapor. Use of this portion of higher boiling naphtha from the second separation zone acts as a reflux and results in the reduction of the amount of high-boiling naphtha in the overhead vapor for a given yield of separated lower boiling naphtha. It is preferred that the first separation zone 2 contain a second gas-liquid contacting zone 9 comprised of suitable trays located vertically above the point of introduction of the effluent from the first hydrodesulfurization stage via line 12, and vertically below the point of introduction of the higher boiling naphtha from the second separation zone via line 22. This also allows for an increase in the yield of separated lower boiling naphtha for a given lower boiling naphtha sulfur content. The more naphtha that bypasses the second hydrodesulfurization zone, the greater the benefit of interstage, or interzone, separation.

A second lower boiling naphtha product stream exits second separation zone 3 via line 24 and is conducted to third separation zone 5 that is maintained at a temperature of at least about 15° C. (59° F.), preferably at about 20° C. (68° F.), and more preferably at least about 25° C. (77° F.) cooler than that of second separation zone 3. A hydrogen containing vapor stream exits third separation zone 5 via line 26 and is passed to scrubbing zone 6 where it is contacted with a basic solution, preferably an amine-containing solution to remove $H_2S$ before recycle via line 28 to first hydrodesulfurization stage 1. A portion of recycle hydrogen can be passed via line 30 to line 16 to flow countercurrent in first separation zone 2. A portion of recycle hydrogen can also be passed, via line 38 to the second hydrodesulfurization zone. The naphtha product effluent stream from second hydrodesulfurization zone 4 is conducted to third separation zone 5 via line 27. A third higher boiling naphtha product stream from third separation zone 5 is passed via line 32 to stripping zone 7 wherein substantially all of any remaining $H_2S$ is stripped from the stream and collected via line 34. The stripped naphtha product stream is then collected via line 36.

In a preferred embodiment, the effluent from second hydrodesulfurization stage is cooled to approximately the temperature of the third separation zone and passed into the third separation zone for concurrent recovery of the desulfurized naphthas from the first and second hydrodesulfurization zones. Hydrogen containing vapor from both hydrodesulfurization stages is likewise concurrently separated from the desulfurized naphthas and passed to amine scrubbing followed by recycle of at least a portion of the gas to either or both hydrodesulftirization stages.

The invention claimed is:

1. A process for hydrodesulfurizing olefinic naphtha feedstreams and retaining a substantial amount of the olefins, which feedstream boils in the range of about 50° F. (10° C.) to about 450° F. (232° C.) and contains organically-bound sulfur and an olefin content of at least about 5 wt. %, which process comprises:

a) hydrodesulfurizing the olefinic naphtha feedstream in a first hydrodesulfurization stage in the presence of hydrogen and a hydrodesulfurization catalyst, at hydrodesulfurization reaction conditions including temperatures from about 232° C. (450° F.) to about 427° C. (800° F.), pressures of about 60 to about 800 psig (about 515 to about 5,617 kPa), and hydrogen treat gas rates of about 1000 to about 6000 standard cubic feet per barrel (about 178 to about 1,058 $m^3/m^3$), to convert at least about 50 wt. %, but not all, of the organically-bound sulfur to hydrogen sulfide and to produce a sulfur-containing first product stream;

b) conducting said sulfur-containing first product stream to a first separation zone operated at a temperature from about 93° C. (200° F.) to about 177° C. (350° F.) where it is contacted with a countercurrent flow of hydrogen treat gas to produce a first lower boiling naphtha product stream and a first higher boiling naphtha product stream, wherein the higher boiling product stream contains greater than about 50 wt. % of the sulfur from the first product stream;

c) conducting said first lower boiling naphtha product stream to a second separation zone operated at a temperature at least 15° C. (27° F.) lower than that of said first separation stage wherein a second lower boiling naphtha product stream and a second higher boiling product stream are produced, which second higher boiling product stream contains substantially all of the sulfur from said first lower boiling naphtha product stream;

d) conducting said second lower boiling product stream from said second separation stage to a third separation stage which is maintained at a temperature at least about 15° C. (27° F.) lower than that of said second separation stage thereby resulting in a hydrogen containing vapor recycle stream and a desulfurized naphtha product stream;

e) conducting said first higher boiling naphtha product stream from said first separation zone and at least a portion of said second higher boiling naphtha stream from said second separation zone to a second hydrodesulfurization stage in the presence of hydrogen treat gas and a hydrodesulfurization catalyst, at hydrodesulfurization reaction conditions including temperatures from about 232° C. (450° F.) to about 427° C. (800° F.), pressures of about 60 to about 800 psig (about 515 to about 5,617 kPa), and hydrogen treat gas rates of about 1000 to about 6000 standard cubic feet per barrel (about 178 to about 1,068 $m^3/m^3$), to convert at least a portion of any remaining organically-bound sulfur to hydrogen sulfide;

f) recycling at least a portion of the hydrogen containing vapor recycle stream from said third separation zone to said first hydrogenation stage;

g) stripping substantially all remaining hydrogen from said desulfurized naphtha product stream from said third separation zone; and h) collecting said stripped desulfurized naphtha product stream.

2. The process of claim 1 wherein at least a portion of said second higher boiling naphtha product stream is conducted to said first separation zone and flows downward countercurrent to an upflowing hydrogen-containing vapor stream.

3. The process of claim 1 wherein at least a portion of said hydrogen-containing vapor from said third separation zone is conducted to said first separation zone where it flows countercurrent to downflowing naphtha.

4. The process of claim 1 wherein the hydrogen-containing vapor recycle stream from said third separation zone is conducted to an amine scrubbing zone where $H_2S$ is separated from said hydrogen-containing vapor stream.

5. The process of claim 1 wherein the hydrodesulfurization catalyst for said first, second, or both hydrodesulfurization stages is comprised of a Co catalytic component, a Mo catalytic component and a support component, wherein the Co component, as its oxide form, is present in an amount from about 2 to about 20 wt. % and the Mo component, as the oxide form, is present in an amount from about 5 to about 50 wt. %, on support.

6. The process of claim 5 wherein the Co component, as its oxide form, is present in an amount from about 4 to 12 wt. % and the Mo component, in its oxide form, is present in an amount from about 10 to 40 wt. %, on support.

7. The process of claim 1 wherein the catalyst for said hydrodesulfurization stage is characterized by the properties:

(a) a $MoO_3$ concentration of about 2 to about 18 wt. %; (b) a CoO concentration of about 0.1 to about 6 wt. %; both weight percents based on the total weight of the catalyst; (c) a Co/Mo atomic ratio of about 0.1 to about 1.0; (d) a median pore diameter of about 60 Å to about 200 Å; (e) a $MoO_3$ surface concentration of about $0.5\times10^{-4}$ to about $3\times10^{-4}$ grams $MoO_3/m^2$; and (f) an average particle size diameter of less than 2.0 mm.

8. The process of claim 7 wherein: (a) the $MoO_3$ concentration is about 4 to about 10 wt. %; (b) the CoO concentration is about 0.5 to about 5.5 wt. %; (c) the Co/Mo atomic ratio is about 0.20 to about 0.80; (d) the median pore diameter is 75 Å to about 175 Å; e) the $MoO_3$ surface concentration is about $0.75\times10^{-4}$ to about $2.5\times10^{-4}$ grams $MoO_3/m^2$; and (f) the average particle size diameter is less than about 1.6 mm.

9. The process of claim 5 wherein the catalyst for said hydrodesulfurization stage is characterized by the properties: (a) a $MoO_3$ concentration of about 2 to about 18 wt. %; (b) a CoO concentration of about 0.1 to about 6 wt. %; both weight percents based on the total weight of the catalyst; (c) a Co/Mo atomic ratio of about 0.1 to about 1.0; (d) a median pore diameter of about 60 Å to about 200 Å; (e) a $MoO_3$ surface concentration of about $0.5\times10^{-4}$ to about $3\times10^{-4}$ grams $MoO_3m^2$; and (f) an average particle size diameter of less than 2.0 mm.

* * * * *